US008336604B2

(12) United States Patent
Machet et al.

(10) Patent No.: US 8,336,604 B2
(45) Date of Patent: Dec. 25, 2012

(54) MANUFACTURING METHOD FOR A MULTI-CHANNEL COPPER TUBE, AND MANUFACTURING APPARATUS FOR THE TUBE

(75) Inventors: David Machet, Johannesburg (ZA); Antonio Rodrigues Da Cruz, Johannesburg (ZA); Vladimir Shoilovich Ziserman, Johannesburg (ZA); Kenichi Takagi, Kitamoto (JP)

(73) Assignees: CTA Technology (Proprietary) Limited, Johannesburg (ZA); Mitsubishi Materials Corporation, Tokyo (JP)

( * ) Notice: Subject to any disclaimer, the term of this patent is extended or adjusted under 35 U.S.C. 154(b) by 177 days.

(21) Appl. No.: 12/448,172

(22) PCT Filed: Dec. 14, 2007

(86) PCT No.: PCT/JP2007/074590

§ 371 (c)(1),
(2), (4) Date: Jun. 11, 2009

(87) PCT Pub. No.: WO2008/072787

PCT Pub. Date: Jun. 19, 2008

(65) Prior Publication Data

US 2010/0021755 A1 Jan. 28, 2010

(30) Foreign Application Priority Data

Dec. 14, 2006 (ZA) ..... 2006/10521

(51) Int. Cl.
*B22D 11/00* (2006.01)

(52) U.S. Cl. ..... 164/465; 164/421

(58) Field of Classification Search ..... 164/421–422, 164/464–465

See application file for complete search history.

(56) References Cited

U.S. PATENT DOCUMENTS

| | | | | |
|---|---|---|---|---|
| 1,841,350 A | | 1/1932 | Staples | |
| 2,721,651 A | * | 10/1955 | Roth | 72/478 |
| 3,136,008 A | * | 6/1964 | Maier et al. | 164/465 |
| 3,347,079 A | | 10/1967 | Rowell | |
| 3,481,391 A | | 12/1969 | Nowak | |

(Continued)

FOREIGN PATENT DOCUMENTS

DE 2940008 * 5/1981

(Continued)

OTHER PUBLICATIONS

International Search Report dated Sep. 17, 2008 and Written Opinion, issued on PCT/JP2007/074590 (16 pages).

(Continued)

*Primary Examiner* — Kuang Lin
(74) *Attorney, Agent, or Firm* — Edwards Wildman Palmer LLP

(57) ABSTRACT

This manufacturing apparatus for a multi-channel tube having a plurality of parallel channels includes: a crucible; and a die set for forming the multi-channel tube from molten copper supplied from the crucible, the die set including: a hollow portion having an inner surface shaped like the profile of the multi-channel tube; punches which are inserted into the hollow portion from an inlet end of the hollow portion to define a space between the inner surface of the hollow portion and each of the punches; and a feed passage which is disposed between the crucible and the space, and configured to feed the molten copper from the crucible to the space, the molten copper being supplied from the crucible to the space within the die set through the feed passage to solidify as it passes through the hollow portion.

13 Claims, 15 Drawing Sheets

U.S. PATENT DOCUMENTS

| | | | | |
|---|---|---|---|---|
| 4,295,516 | A * | 10/1981 | Wilson | 164/464 |
| 4,432,811 | A | 2/1984 | Stiebellehner et al. | |
| 4,935,076 | A | 6/1990 | Yamaguchi et al. | |
| 5,279,353 | A | 1/1994 | Nielsen, Sr. et al. | |
| 2002/0125004 | A1 | 9/2002 | Kraft | |
| 2004/0188056 | A1 | 9/2004 | Hauri et al. | |
| 2008/0251245 | A1 * | 10/2008 | Gorbounov et al. | 165/178 |

FOREIGN PATENT DOCUMENTS

| | | | |
|---|---|---|---|
| DE | 3207267 | A1 | 9/1983 |
| DE | 3626235 | C1 | 11/1987 |
| DE | 19612002 | C1 | 9/1997 |
| EP | 0857529 | | 8/1998 |
| EP | 1174198 | A2 | 1/2002 |
| GB | 2 034 214 | A | 6/1980 |
| JP | 37-000061 | B | 1/1962 |
| JP | 42-006964 | B | 3/1967 |
| JP | 45-019584 | B | 7/1970 |
| JP | 50-075960 | A | 6/1975 |
| JP | 53-026731 | A | 3/1978 |
| JP | 53-048929 | A | 5/1978 |
| JP | 58-070955 | A | 4/1983 |
| JP | 58-097463 | A | 6/1983 |
| JP | 59126742 | A | 7/1984 |
| JP | 61-152367 | U | 9/1986 |
| JP | 04-068299 | | 3/1992 |
| JP | 10-175042 | A | 6/1998 |
| JP | 2001-096338 | A | 4/2001 |
| JP | 2003-021476 | A | 1/2003 |
| JP | 2003268467 | A | 9/2003 |
| JP | 2005-164221 | A | 6/2005 |
| SU | 973224 | * | 11/1982 |
| SU | 1187907 | * | 10/1985 |
| SU | 1329895 | | 8/1987 |

OTHER PUBLICATIONS

Partial European Search Report dated Aug. 13, 2010, issued in the corresponding European Patent Application No. 10 16 6135.3.

European Search Report dated May 11, 2010 and Annex to the European Search Report on European Patent Application No. EP 10 15 8351.6.

Office Action dated Sep. 13, 2010, issued on the counterpart European Patent Application No. 07859915.6.

European Search Report dated Nov. 11, 2010, for European Patent Application No. 10166135.3.

Office Action mailed Dec. 20, 2011, issued for the Japanese patent application No. 2009-524831.

* cited by examiner

MANUFACTURING METHOD FOR A MULTI-CHANNEL COPPER TUBE, AND MANUFACTURING APPARATUS FOR THE TUBE

TECHNICAL FIELD

This invention relates to the manufacturing of copper tube. More particularly the invention provides a method of manufacturing multi-channel copper tube. It further relates to apparatus for use in the manufacture of multi-channel copper tube. In addition it relates to tube drawing apparatus. It also relates to multi-channel copper tube.

Priority is claimed on South African Provisional Patent Application No. 2006/10521, filed Dec. 14, 2006, the content of which is incorporated herein by reference.

BACKGROUND ART

Multi-channel tube is used in numerous applications. One such application is in cooling of electronic components in which multi-channel aluminum tube is used to convey coolant. By virtue of its superior heat transfer properties, it would be preferable to use copper in such applications. However, difficulties are encountered when attempting to manufacture multi-channel tube from copper.

It is an object of this invention to provide means which the Inventors believe will at least alleviate this problem.

In the context of this specification the term "copper" shall be understood to include both copper and copper alloys.

DISCLOSURE OF THE INVENTION

According to one aspect of the invention there is provided a method of manufacturing multi-channel tube having a plurality of parallel channels which includes the step of feeding molten copper into a hollow portion die so as to form the tube by continuous casting.

More particularly, the method may include supplying molten copper from a crucible to a die set to form the multi-channel tube, the die set including a hollow portion having an inner surface shaped like the profile of the multi-channel tube, punches which are inserted into the hollow portion from an inlet end of the hollow portion to define a space between the inner surface of the hollow portion and each of the punches, and a feed passage which is disposed between the crucible and the space, and which is for feeding the molten copper from the crucible to the space, the molten copper being supplied from the crucible to the space within the die set through the feed passage and solidifying as it passes through the hollow portion.

The manufacturing method for a multi-channel tube of the present invention, may further include: supplying the molten copper from the crucible to the space within the die set by gravity.

The manufacturing method for a multi-channel tube of the present invention, may further include: withdrawing the cast multi-channel tube from the die set.

The hollow portion may have an inlet end through which molten copper is fed into the hollow portion die and an outlet end. The method may include the prior step of inserting a length of starter tube into the outlet end of the hollow portion part way along the length of the hollow portion, feeding molten copper into the inlet end of the hollow portion, allowing the molten copper to bond with the starter tube and solidify, and drawing the starter tube out of the hollow portion for a predetermined length or continuously, feeding more molten copper into the hollow portion allowing it to bond with the previously formed tube and solidify and drawing the multi-channel tube out of the hollow portion die on a continuous basis.

The method may include cooling the hollow portion die. Cooling the hollow portion die may include feeding coolant into cooling bores which extend into the hollow portion die from its outlet end for part of its length. The depth to which the coolant is fed into the hollow portion die and hence the position within the hollow portion die at which the molten copper solidifies may be adjustable. This allows the solidification point to be adjusted to compensate for wear of the die set thereby maximizing the life of the die set.

The method may include drawing the cast multi-channel tube through one or more dies in order to obtain the desired wall thickness.

Drawing the multi-channel tube may involve making use of fixed mandrels.

Instead, in at least one drawing operation, the method may include using floating mandrels. The method may include inhibiting spinning of the floating mandrels. In one embodiment of the invention, the method may include making use of non-circular mandrels. Instead, the method may include making use of circular mandrels.

The method may include annealing the multi-channel tube. Annealing the multi-channel tube may include passing it through a furnace.

According to another aspect of the invention there is provided a manufacturing apparatus for a multi-channel tube having a plurality of parallel channels which apparatus includes: a crucible; and a die set for forming the multi-channel tube from molten copper supplied from the crucible, the die set including: a hollow portion having an inner surface shaped like the profile of the multi-channel tube; punches which are inserted into the hollow portion from an inlet end of the hollow portion to define a space between the inner surface of the hollow portion and each of the punches; and a feed passage which is disposed between the crucible and the space, and configured to feed the molten copper from the crucible to the space, the molten copper being supplied from the crucible to the space within the die set through the feed passage to solidify as it passes through the hollow portion.

In the manufacturing apparatus for a multi-channel tube of the present invention, the die set may include: a hollow portion die in which the hollow portion is formed; a punch holder holding the punches and defining a feed cavity which relays the molten copper to be supplied from the crucible to the space between the punches and the hollow portion die; and an intermediate die which is disposed between the crucible and the punch holder, a first feed passage being formed in the intermediate die and second feed passages being formed in the punch holder, the molten copper in the crucible being fed to the space through the feed passage composed of the first and second feed passages, and the feed cavity.

In the manufacturing apparatus for a multi-channel tube of the present invention, the hollow portion die may contain blind cooling bores, the apparatus including cooling elements which are respectively insertable into the cooling bores for cooling the molten copper. The depth of the insertion of each of the cooling elements may be variable.

In the manufacturing apparatus for a multi-channel tube of the present invention, each of the cooling bores may be formed in the hollow portion die the bores being disposed around the hollow portion and extending parallel therewith.

The manufacturing apparatus for a multi-channel tube of the present invention, may further include: a withdrawing device which withdraws the cast multi-channel tube from the die set.

In the manufacturing apparatus for a multi-channel tube of the present invention, the spacing between each of the punches may decrease towards the tips or free ends thereof. In particular, punches spaced outwardly from a central punch may be inclined inwardly towards the central punch towards their free ends or tips thereof. The punches which are furthest from the central punch will be the most steeply inclined. This arrangement will reduce the friction between the punches and the solidified copper thereby reducing wear on the punches.

Preferably, the die set of the manufacturing apparatus is provided with an air pocket which divides the die set into a high-temperature area and a low-temperature area.

According to the other aspect of the invention there is provided apparatus for use in the manufacture of multi-channel copper tube which includes:

a hollow portion die defining a hollow portion which has an inlet end and an outlet end; and a punch holder having a body from which a plurality of punches protrude, the punches being receivable with clearance in the inlet end of the hollow portion, so that they extend part way along the length of the hollow portion, the body being configured to abut sealingly against an end of the hollow portion die and define, together with the hollow portion die, a feed cavity which is in flow communication with the inlet end of the hollow portion and at least one feed passage extending through the body into flow communication with the feed cavity, whereby molten copper can be fed into the feed cavity.

Preferably, a plurality of parallel feed passages extends through the body to permit molten copper to be fed into the feed cavity.

The hollow portion die may include a plurality of cooling bores which extend longitudinally into the hollow portion die from its outlet end for part of its length. The cooling bores may be arranged around the hollow portion and in particular may comprise a plurality of parallel blind holes extending into the hollow portion die.

The invention extends to tube drawing apparatus which includes:

a drawing die;

drawing means for drawing tube through the drawing die; and a mandrel receivable in the tube to be drawn.

The invention extends further to tube drawing apparatus for drawing multi-channel tube having a plurality of channels which includes:

a drawing die defining a slit the shape of which corresponds to the intended profile of the multi-channel tube after drawing;

drawing means for drawing multi-channel tube through the drawing die slit; and a plurality of mandrels, one of which is receivable in each channel of the multi-channel tube to be drawn.

According to yet another aspect of the invention there is provided multi-channel copper tubing which includes at least two parallel tubular channels which are connected together by a longitudinal connecting web which has a minimum thickness which is not less than the minimum wall thickness of the channels.

Preferably, the tube has a ratio of minimum web thickness to minimum wall thickness of between 1:1 and 4:1. More particularly, the ratio is 1.5:1.

The grain size of the copper tubing may be less than or equal to 2.0 mm.

BEST MODE FOR CARRYING OUT THE INVENTION

Figure 1:
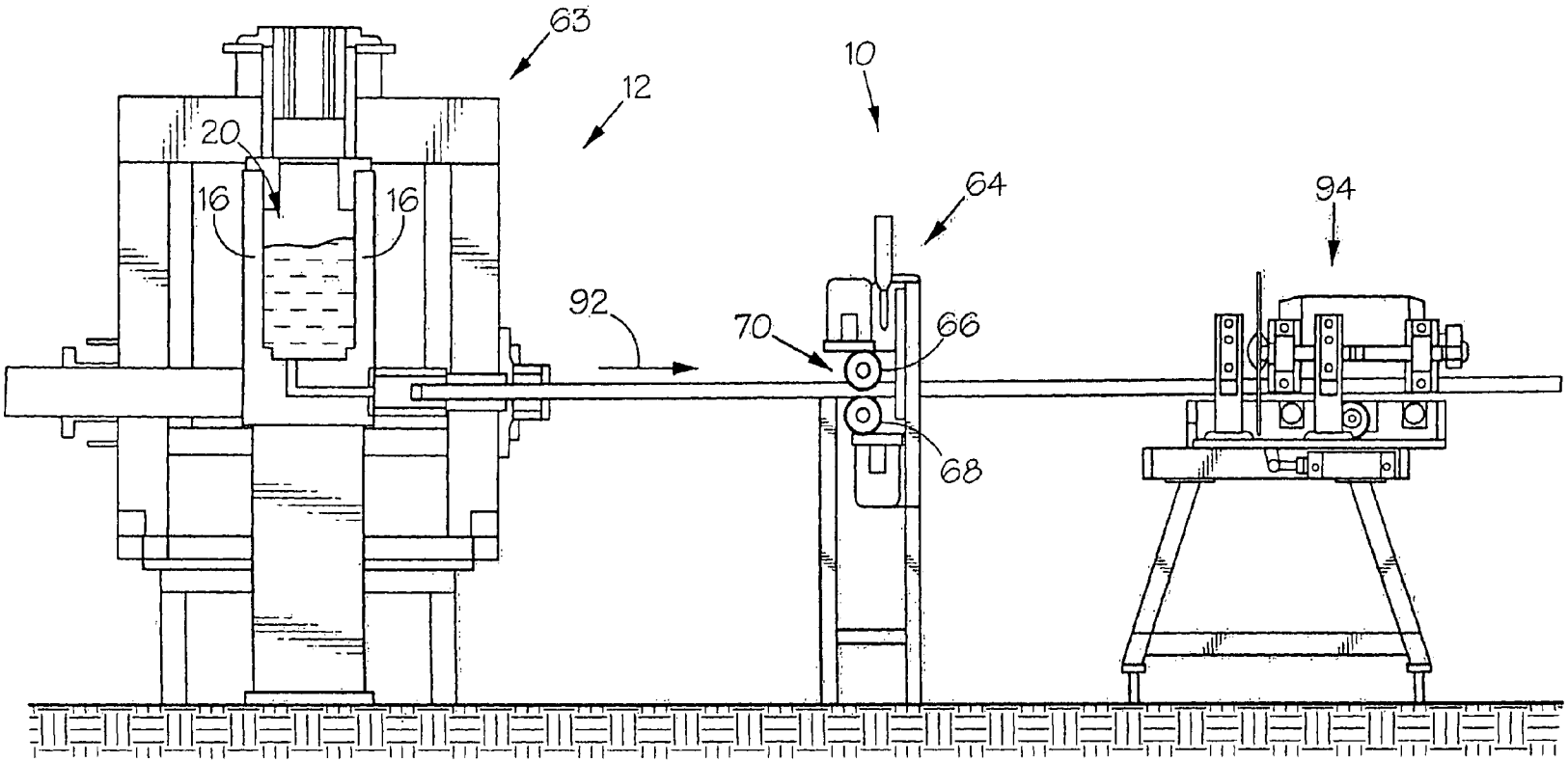
FIG. 1 shows a schematic side view of part of an apparatus for manufacturing multi-channel copper tube in accordance with the invention.

In FIG. 1 of the drawings, reference numeral 10 refers generally to apparatus for use in the manufacture of multi-channel copper tube 100 in accordance with the invention.

Figure 11:
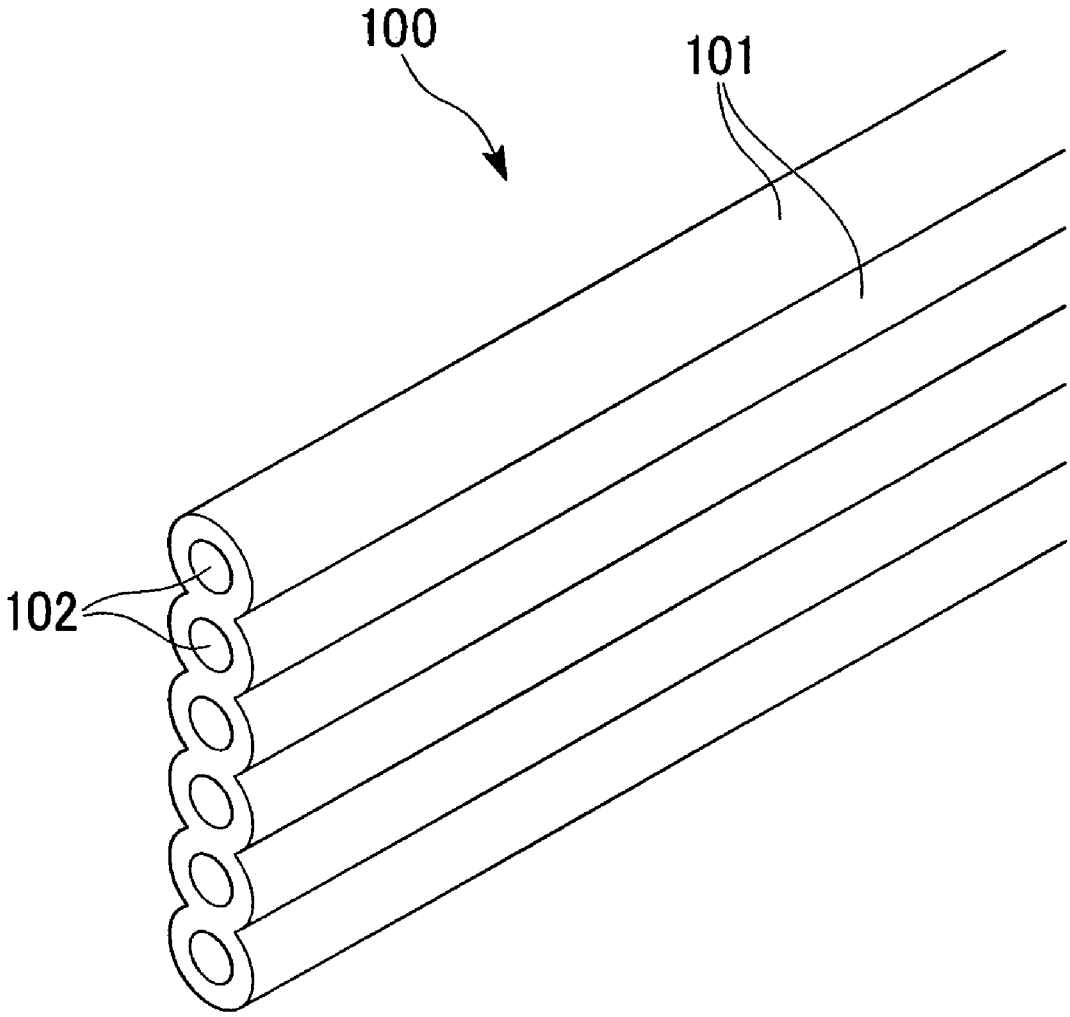
FIG. 11 shows a three-dimensional view of part of a multi-channel tube.

The multi-channel copper tube 100 is composed of a plurality of integrally formed tubes 101 being arranged in a line (refer to FIG. 11). In each of the tubes 101, a channel 102 is formed.

Figure 10:
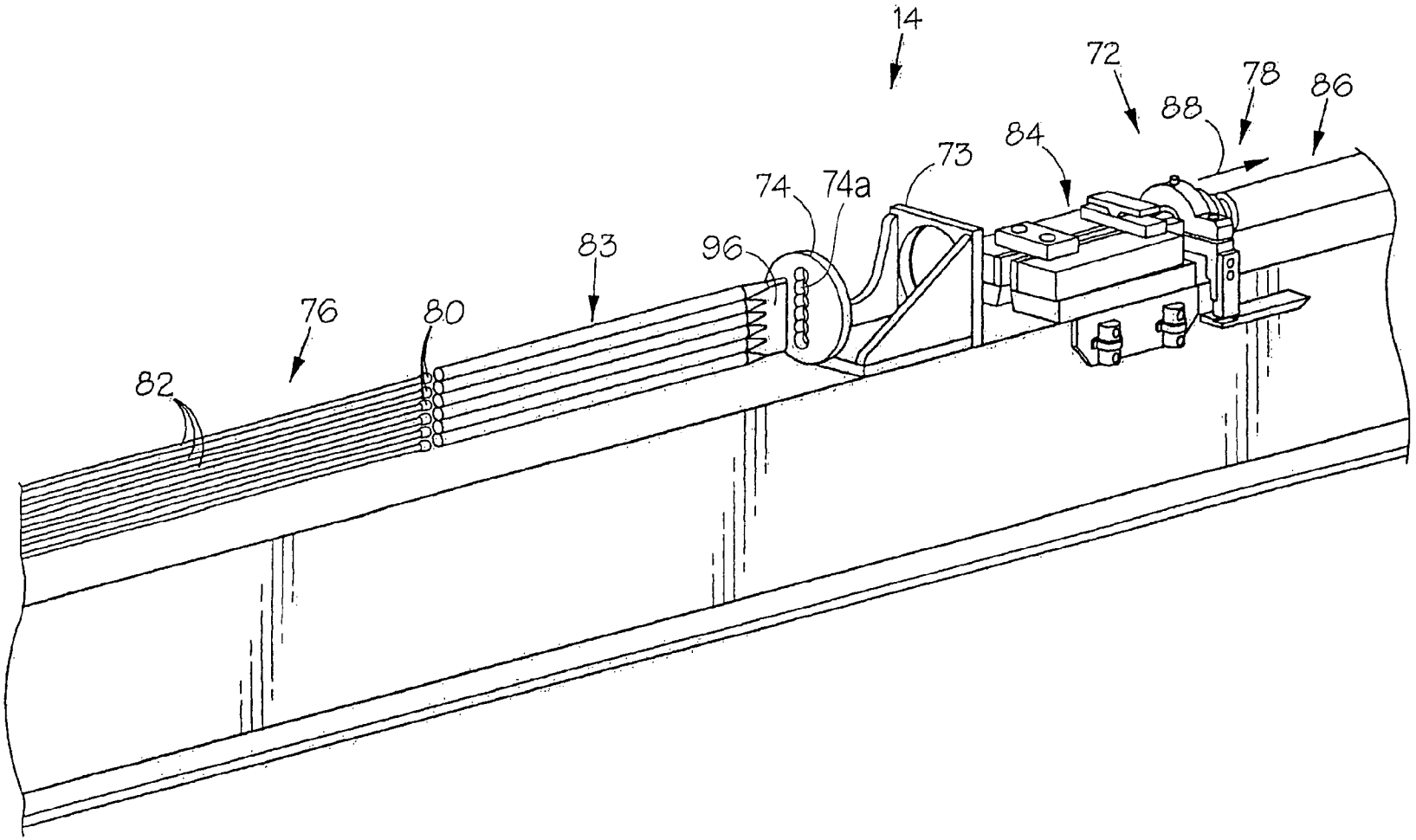
FIG. 10 shows a three-dimensional view of part of a tube drawing apparatus in accordance with the invention.

The apparatus 10 includes a casting unit, generally indicated by reference numeral 12 and tube drawing apparatus, generally indicated by reference numeral 14 (FIG. 10).

Figure 2:
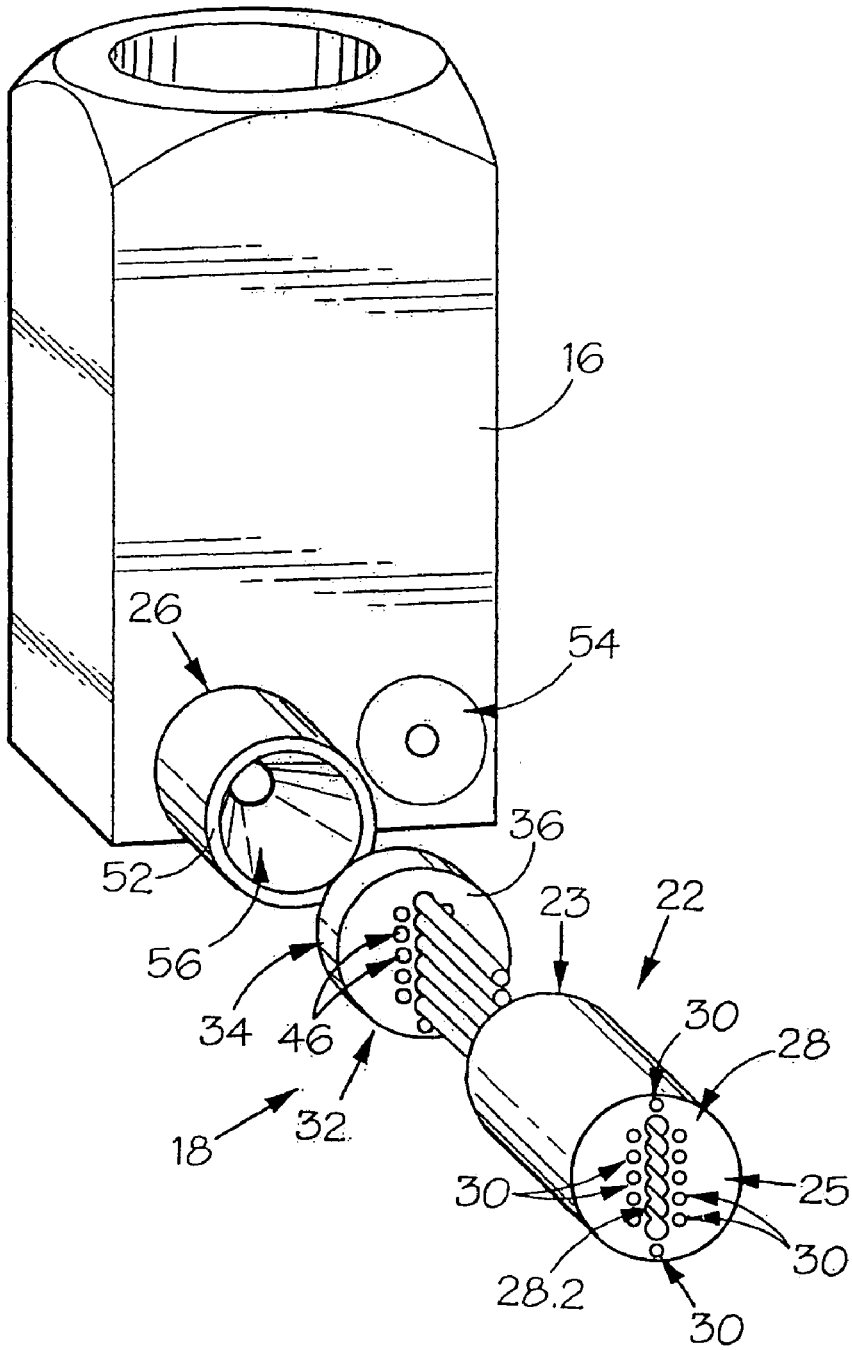
FIG. 2 shows a three-dimensional exploded view of part of an apparatus for use in the manufacture of multi-channel copper tube in accordance with the invention.
Figure 3:
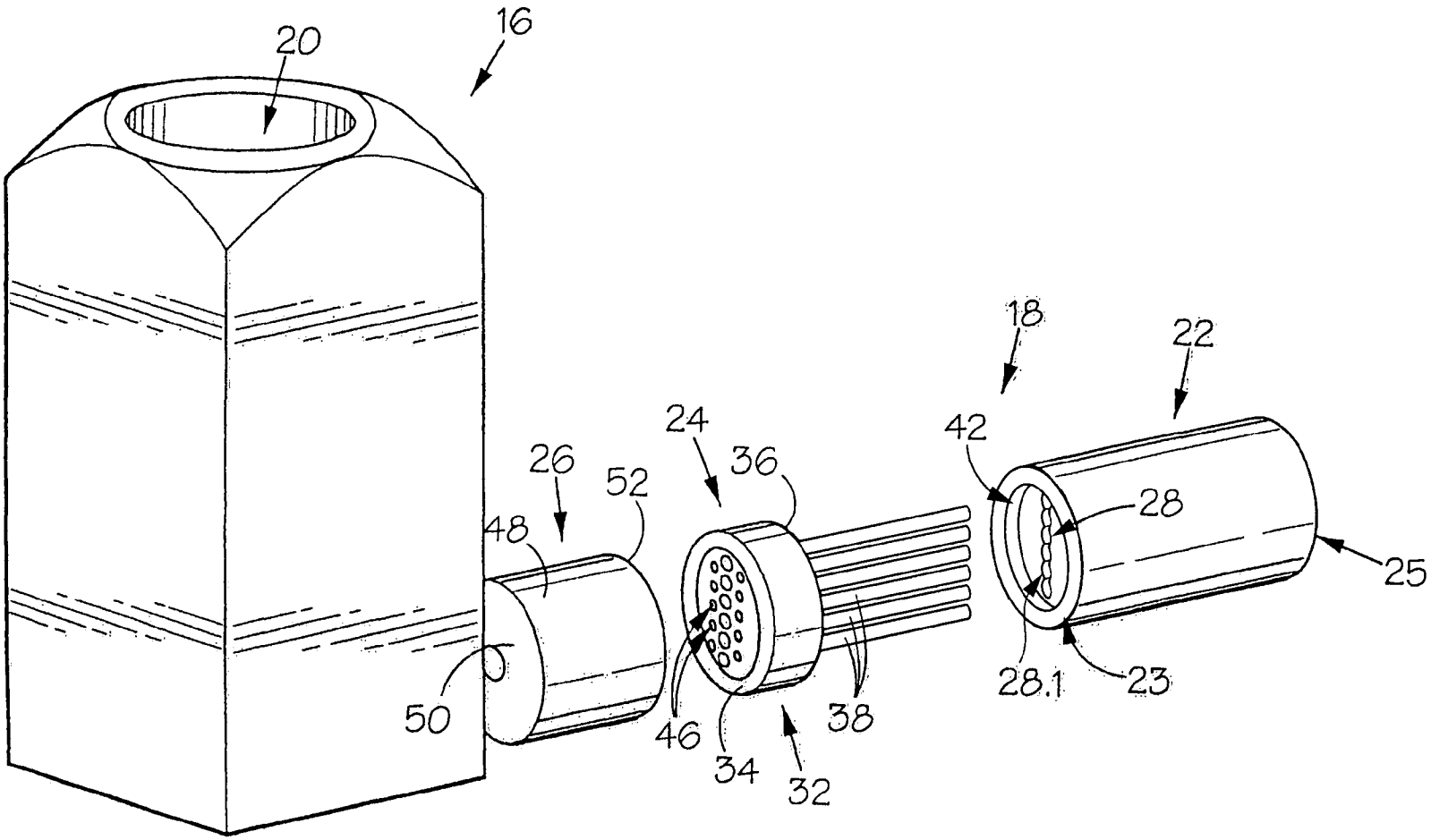
FIG. 3 shows a three-dimensional exploded view from the rear of the part of the apparatus shown in FIG. 2.
Figure 4:
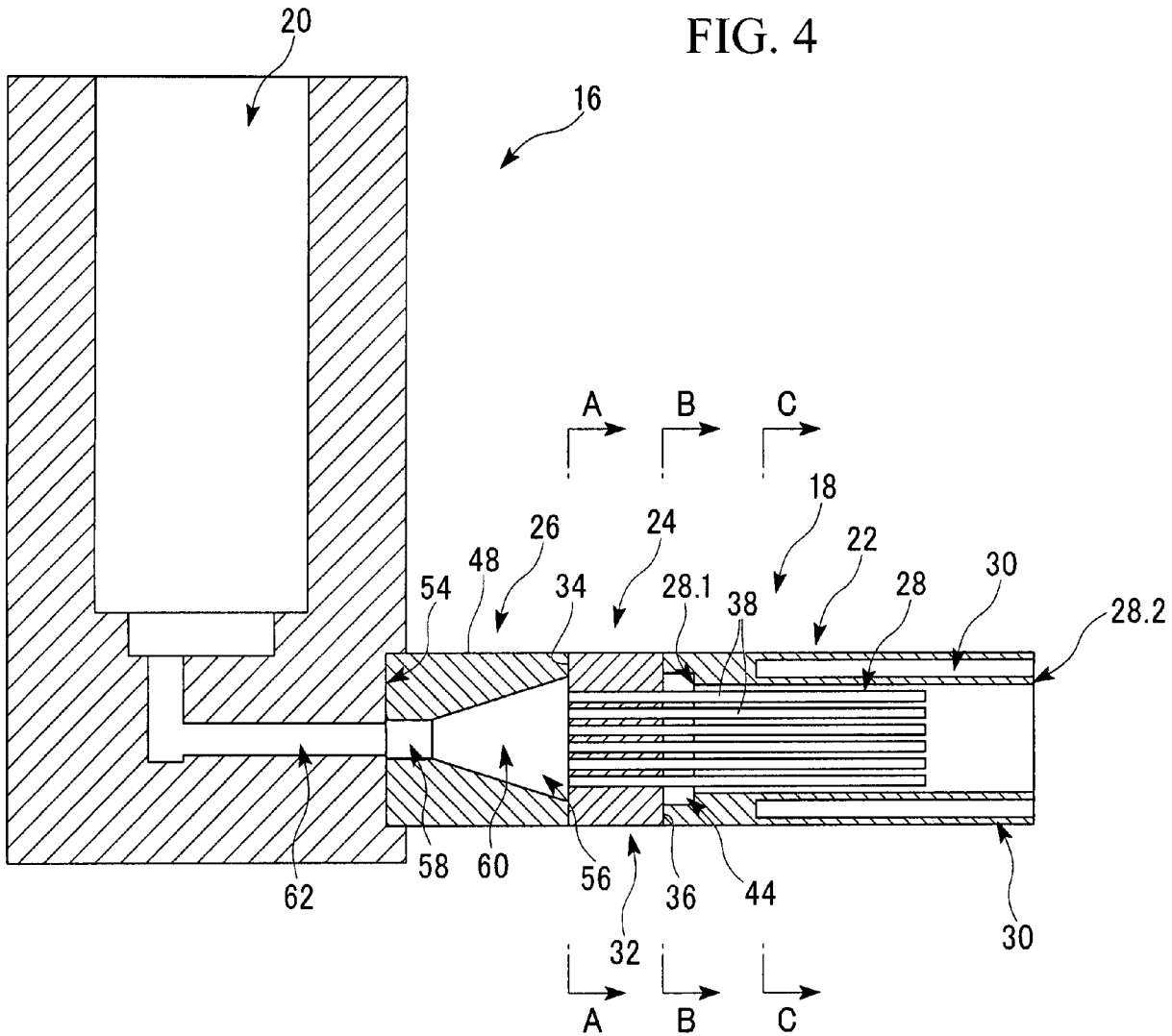
FIG. 4 shows, on an enlarged scale, a sectional view of the part of the apparatus of FIGS. 2 and 3.
Figure 5:
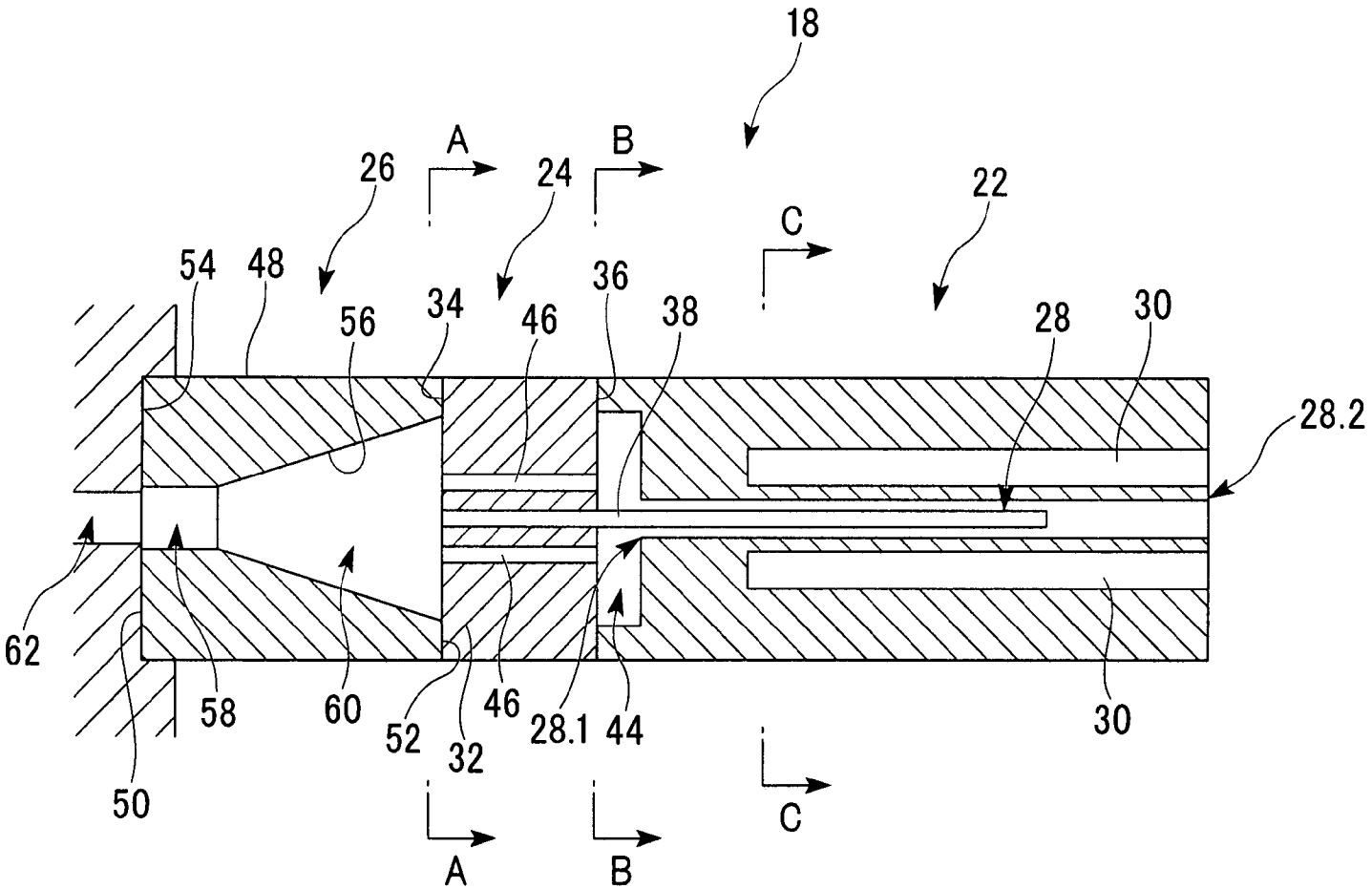
FIG. 5 shows, on an enlarged scale, a sectional view of the part of the apparatus of FIGS. 2 and 3.
Figure 6:
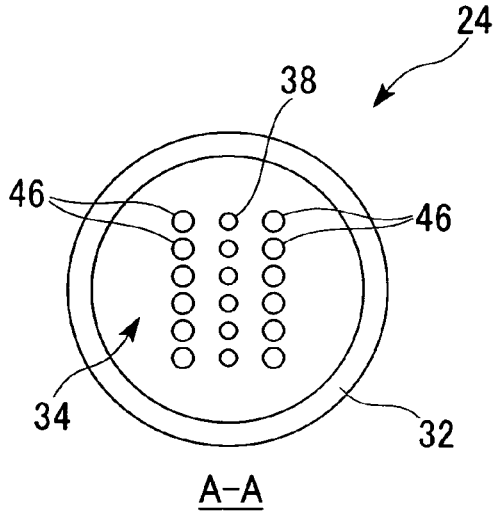
FIG. 6 shows, on an enlarged scale, a sectional view taken along line A-A of the part of the apparatus of FIG. 5.
Figure 7:
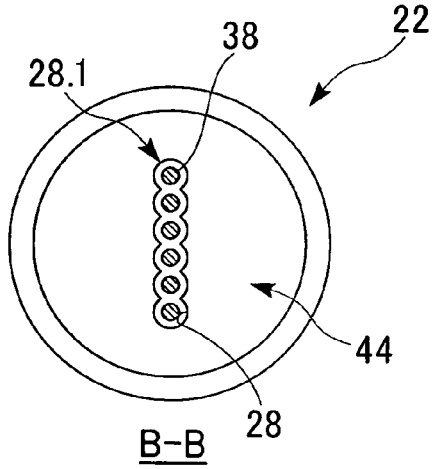
FIG. 7 shows, on an enlarged scale a sectional view taken along a line B-B of the part of the apparatus of FIG. 5.
Figure 8:
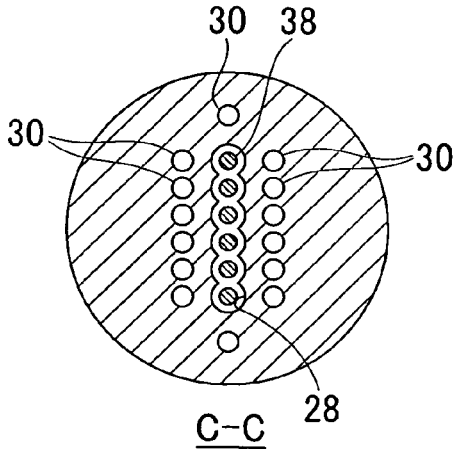
FIG. 8 shows, on an enlarged scale, a sectional view taken along a line C-C of the part of the apparatus of FIG. 5.

Referring now also to FIGS. 2 to 4, the casting unit 12 includes a crucible 16 to which a pair of die sets 18, one of which is shown in the drawings, is connectable in flow communication with a chamber 20 defined in the crucible 16.

Each die set 18 includes a multi-channel die 22, a punch holder 24 and an intermediate die 26.

The multi-channel die 22 has a cylindrical body and has a pair of ends 23, 25. A hollow portion 28 extends through the body.

The inner surface of the hollow portion 28 is shaped like the profile of the multi-channel tube 100. The hollow portion 28 has an inlet end 28.1 and an outlet end 28.2 which open out respectively of the opposed ends 23, 25 of the multi-channel die 22. Blind cooling bores 30 extend longitudinally inwardly into the multi-channel die 22 from the end 25. The cooling bores 30 are arranged in two sets positioned on opposite sides of the hollow portion 28. In addition a bore 30 is provided above and below the hollow portion 28. The cooling bores 30 extend longitudinally inwardly for part of the length of the multi-channel die 22.

The punch holder 24 includes a circular cylindrical body 32 having a pair of ends 34, 36. A plurality of elongate tapered or parallel punches 38 protrude from the end 35 of the body 32. The punches 38 are inserted into the hollow portion 28 from the inlet end 28.1 of the hollow portion 28 to define a space between the inner surface of the hollow portion 28 and each of the punches 38, and are receivable with clearance in the inlet ends 28.1 of the hollow portion 28. Hence, a space is defined between the inner surface of the hollow portion 28 and each of the punches 38. The space has a cross-section which corresponds substantially to the desired cross-section of the copper tube 100. The end 23 of the multi-channel die 22 has a recessed central portion 42 which, in use, together with the end 36 of the punch holder 24 defines a feed cavity 44 (FIGS. 4 to 8).

Two sets of feed passages (that is, second feed passages) 46 extend through the body 32 and open out of the ends 34, 36. The sets of feed passages 46 are positioned on opposite sides of the punches 38.

The intermediate die 26 has a circular cylindrical body 48 having ends 50, 52. The end 50 abuts sealingly against a complementary circular recessed surface 54 provided on the crucible 16. The end 52 is seated sealingly against the end 34 of the body 32. A feed passage (that is, first feed passage) 56 extends through the body 48 and opens out of the ends 50, 52. The passage 56 has a circular cylindrical portion 58 which extends longitudinally inwardly from the end 50 and a frustoconical portion 60 which opens out of the end 52. A passage 62 connects the chamber 20 in flow communication with the passage 56 which in turn is in flow communication with the feed passages 46 which lead into the feed cavity 44 and the hollow portion 28.

The crucible 16, the multi-channel die 22, the body 32 of the punch holder 24 and the intermediate die 26 are typically formed of graphite and are held in sealing abutment with one another in a support structure, generally indicated by reference numeral 63 (FIG. 1).

The casting unit 12 further includes a tube withdrawal unit, generally indicated by reference numeral 64. The tube extracting unit 64 includes a pair of rollers 66, 68 which define between them a nip zone, generally indicated by reference numeral 70 for withdrawing multi-channel copper tube from the multi-channel die 22, as described in more detail here below.

Referring now to FIG. 10 of the drawings, the drawing apparatus 14 includes a draw bench 72 having a die support 73 on which is mounted a drawing die 74. In the drawing die 74, a slit 74*a* which is substantially similar in shape to but of smaller dimension than the hollow portion 28 is formed. Mounted on opposite sides of the drawing die 74 are a mandrel support, part of which is generally indicated by reference numeral 76 and drawing means, generally indicated by reference numeral 78.

The mandrel support 76 includes a plurality of mandrels 80 each of which is mounted on the end of a rod of wire 82. The mandrels 80 are displaceable between a retracted position in which a length of multi-channel tube 83 is receivable between the mandrels and the drawing die 74 and an extended position in which the mandrels 80 are inserted into the channels in the multi-channel tube 83 in a position adjacent to the drawing die 74.

The drawing means 78 includes clamping jaws 84 and an hydraulically actuated displacement arrangement, generally indicated by reference numeral 86 whereby the jaws 84 are displaceable between an extended position (shown in FIG. 10) in which they are positioned adjacent to the drawing die 74 releasably to engage an end of a length of multi-channel tube 83 and a displaced position in which they are displaced in the direction of arrow 88 away from the drawing die 74.

Figure 9:
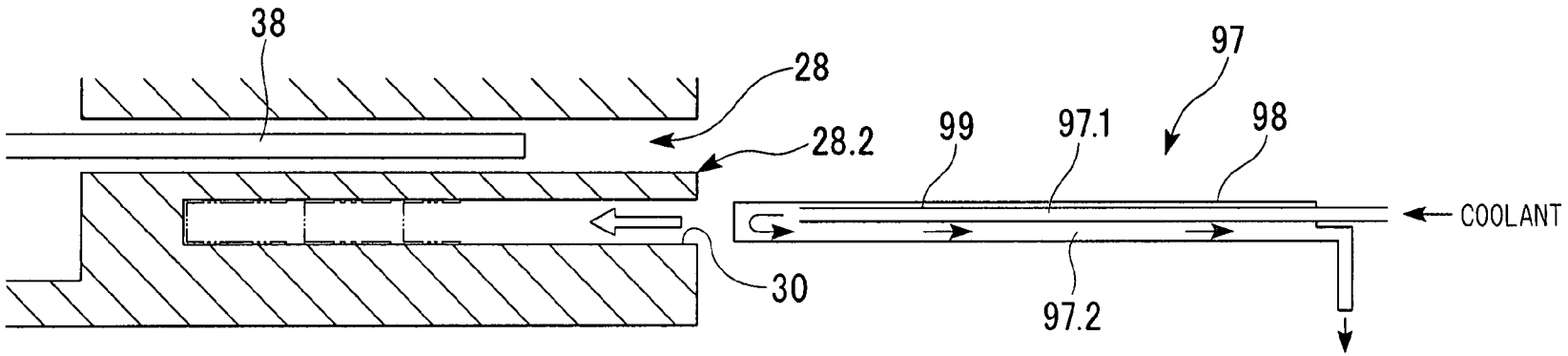
FIG. 9 shows, on an enlarged scale, a sectional view of the part of the apparatus of FIG. 5.

In FIG. 9, cooling elements 97 are received in the cooling bores 30. Each cooling element 97 includes an outer tubular member 98 which is closed at its one end and an inner tubular member 99 which is positioned concentrically within the outer tubular member 98 so as to define a tubular inner passage 97.1 and an annular outer passage 97.2. Coolant, typically water, is fed through the inner passage 97.1 and flows to the end of the passage where it then enters and flows along the outer passage 97.2. The depth to which the cooling elements 97 can be inserted into the cooling bores 30 is adjustable.

In use, a length of multi-channel starter tube is inserted into the hollow portion 28 in the multichannel die 22 from the outlet end 28.2 thereof for part of its length.

Copper is introduced into the chamber 20 in the crucible 16 and is melted. The molten copper flows under the influence of gravity through the passages 62, 56 and the feed passages 46 into the feed cavity 44. From there, the molten copper flows into the space defined between the inner surface of the hollow portion 28 and each of the punches 38 until it comes into contact with the end of the starter tube. The cooling elements 97 will typically be positioned only part way into the cooling bores 30 such that the copper solidification point can be controlled in the hollow portion 28.

The starter tube is then displaced in the direction of arrow 92 (FIG. 1) by a predetermined distance. This draws the solidified tube in the direction of arrow 92 towards the outlet end 28.2 of the hollow portion 28. Further copper then flows into the inlet end of the hollow portion 28 and bonds with the copper ahead of it and solidifies. By repeating this procedure, the multi-channel tube is cast. Initially the starter tube and eventually the newly formed tube is drawn out of the multi-channel die 22 by displacing one or both of the rollers 66, 68 of the tube extracting unit 64.

Copper is a very abrasive material and as a result substantial wear occurs on the surfaces of the hollow portion 28. By varying the depth to which the cooling elements are inserted, the point at which the copper solidifies can be varied. Consequently, as the depth to which the cooling elements are respectively inserted into the cooling bores 30 increases the copper solidification point becomes closer to the inlet end 28.1 of the hollow portion 28. Alternatively as the cooling elements are respectively withdrawn from the cooling bores 30, i.e. the depth to which they are inserted decreases the copper solidification point moves towards the outlet end 28.2 of the hollow portion 28. It is preferable that the copper solidification point moves as time advances from the start of casting of the molten copper to the die set. Accordingly, the maximum possible working life of the multi-channel die 22 can be achieved.

It will be appreciated that the multi-channel tube formed in this manner can be of indefinite length. However, from a practical point of view, the multi-channel tube will typically be cut into useful lengths by a tube cutting machine, generally indicated by reference numeral 94 (FIG. 1). In order to provide the multi-channel tube with channels having wall thicknesses of the desired dimensions, use is made of the drawing apparatus 14. In this regard, it will be appreciated that one or more drawing stages may be used. However, only one stage is described here below.

An end of the length of multi-channel tube 83 is swaged in a press to provide an end portion 96 which is flat and which can be gripped in the clamping jaws 84.

With the mandrels 80 in their retracted positions spaced from the openings in the drawing die 74, a length of multi-channel tube 83 is positioned between the die (shown in FIG. 10) and the mandrels 80. The mandrels 80 are then displaced to their extended positions into the open ends of the channels until they are positioned adjacent the drawing die 74. The end portion 96 is inserted through the drawing die 74 and is gripped by the clamping jaws 84. The clamping jaws 84 are then displaced in the direction of arrow 88 thereby drawing the length of multi-channel tube through the drawing die 74 in the space defined between the drawing surface of the slit of the drawing die 74 and the mandrels 80 thereby decreasing the wall thickness and increasing the length of the multi-channel tube.

As mentioned above, this procedure can be repeated a number of times until a multi-channel tube having a desired wall thickness is provided.

Further, the Inventors believe that instead of using fixed mandrels in the manner described above floating mandrels could be used. In this case, instead of being attached to the wire rods 82, the mandrels 80 is inserted into the open end of the multi-channel tube prior to drawing the multi-channel tube through the drawing die 74.

The Inventors believe that the invention provides a cost effective manner for reliably producing multi-channel copper tubes. In addition, multi-channel tube produced in this fashion has an equiaxed grain structure.

Figure 12:
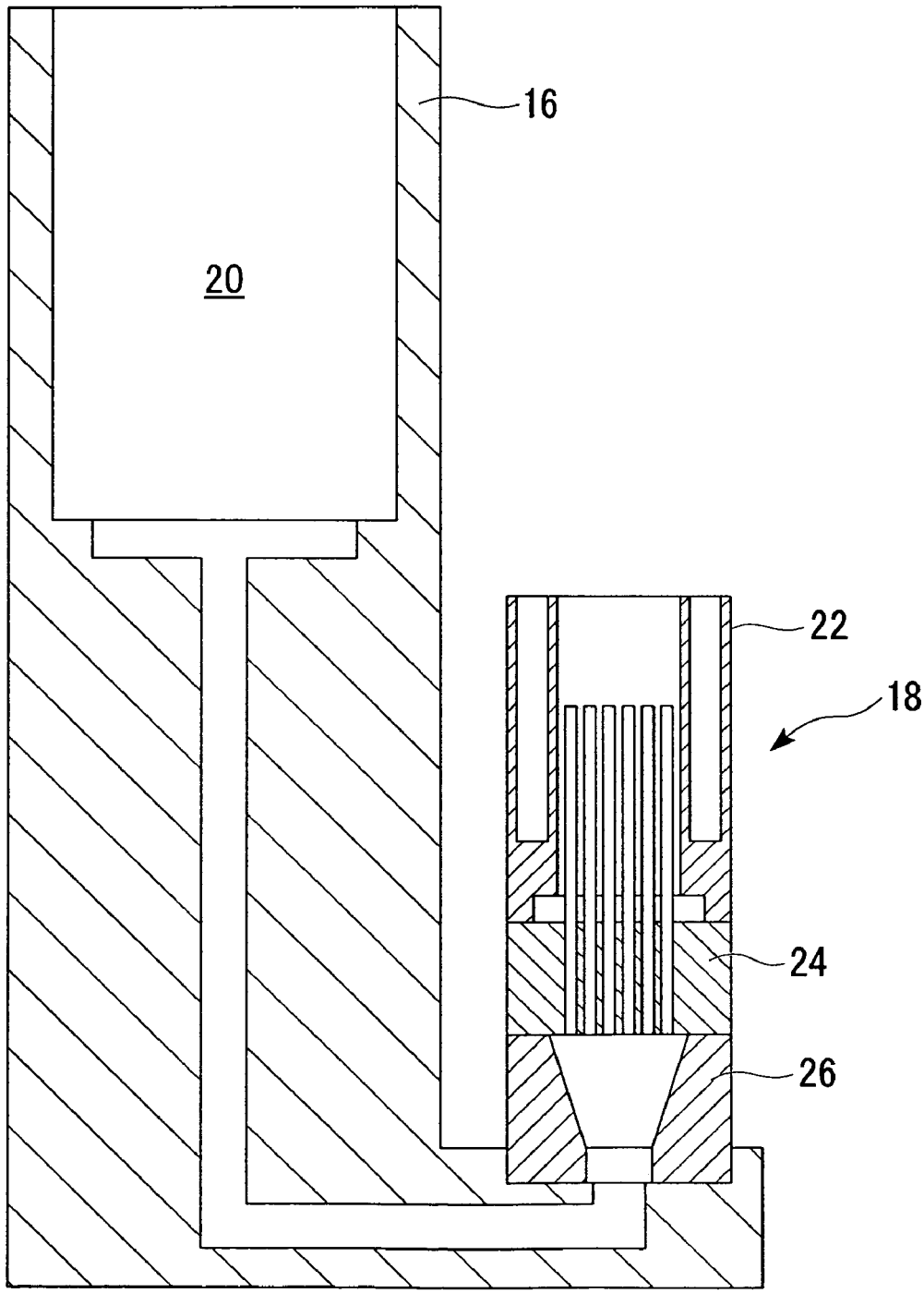
FIG. 12 shows a sectional view of a variant of the apparatus.

With the present invention, the die set may be arranged so as to be in the vertical direction (refer to FIG. 12). In this case, the die set must be positioned so that the outlet end 28.2 of the hollow portion 28 is lower than an inner bottom surface of the chamber 20 of the crucible 16. Therefore, the incidence of shrinkage cavities can be suppressed by effectiveness of a feeding head of the molten copper.

Figure 13:
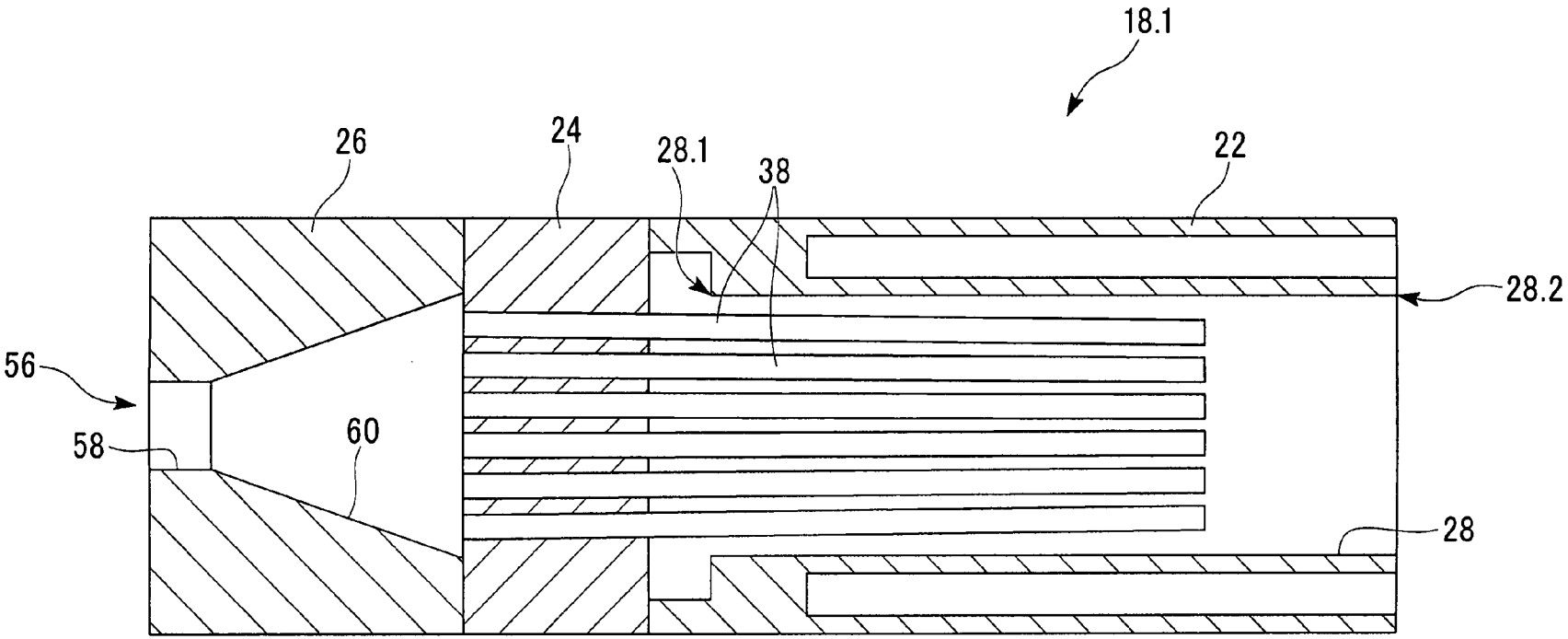
FIG. 13 shows a sectional view of a variant of the die set included in the apparatus.

Further, the punches 38 of a die set 18.1 can be arranged so that the distance between each of the punches 38 decreases towards the tips thereof (refer to FIG. 13). To this end, the central punch or punches will be generally linear. The punches which are spaced outwardly from the central punch or punches will be inclined, at least towards the ends thereof, towards the central punch or punches thereby to decrease the spacing therebetween. It will accordingly be understood that the outermost punches will be inclined inwardly to the greatest degree. As a result of the curvature or inclination of the punches, friction between the punches and solidified copper is reduced in which return reduces the wear on the punches and maximizes their working life.

Furthermore, it is not always necessary to form each of the cooling bores parallel to the longitudinal direction of the die set. For example, each of the cooling bores may be formed in the orthogonal direction of the die set. By varying the depth to which the cooling elements are inserted, the point at which the copper solidifies can be varied.

Figure 14:
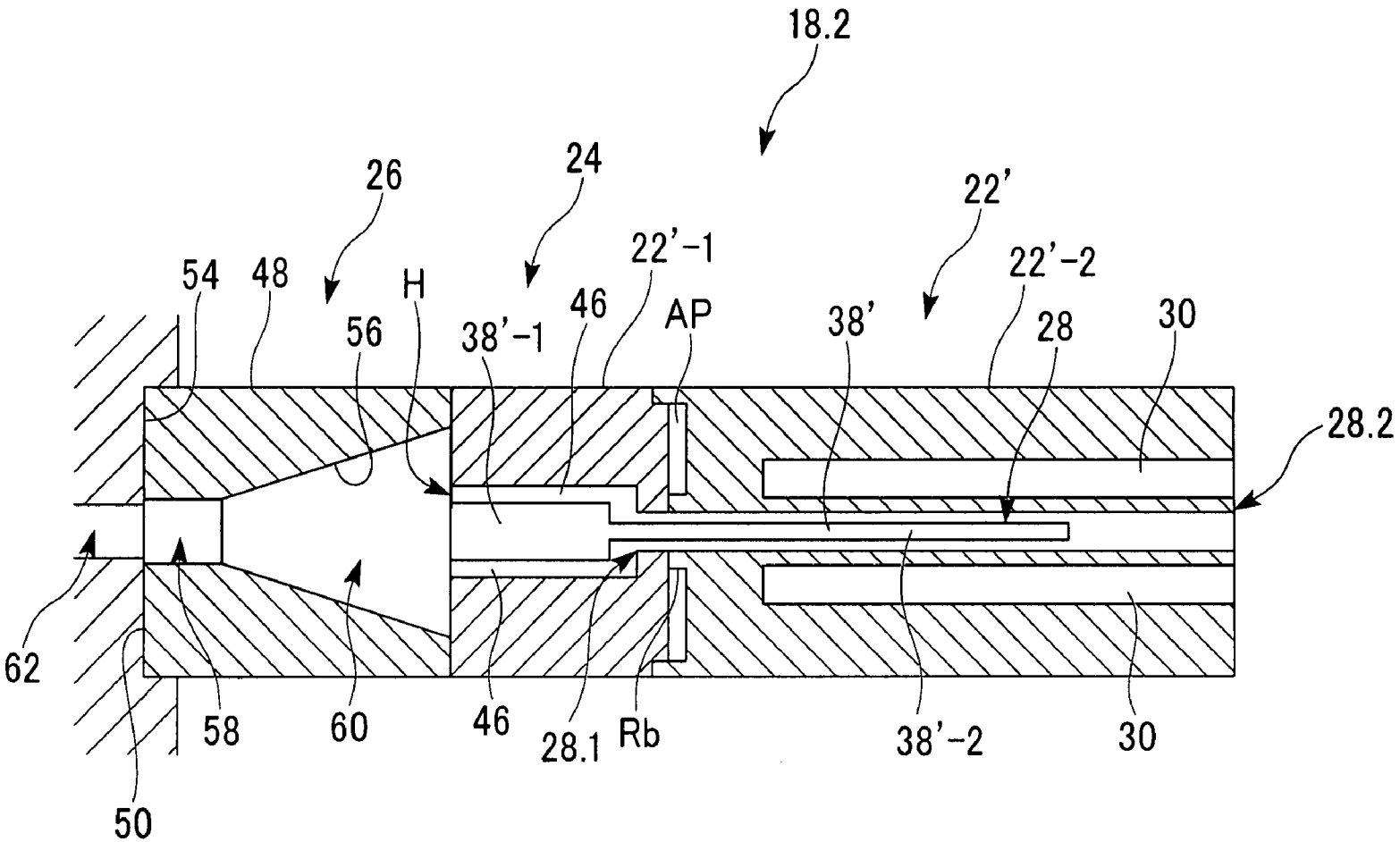
FIG. 14 shows, on an enlarged scale, a sectional view of a variant of the die set.
Figure 15:
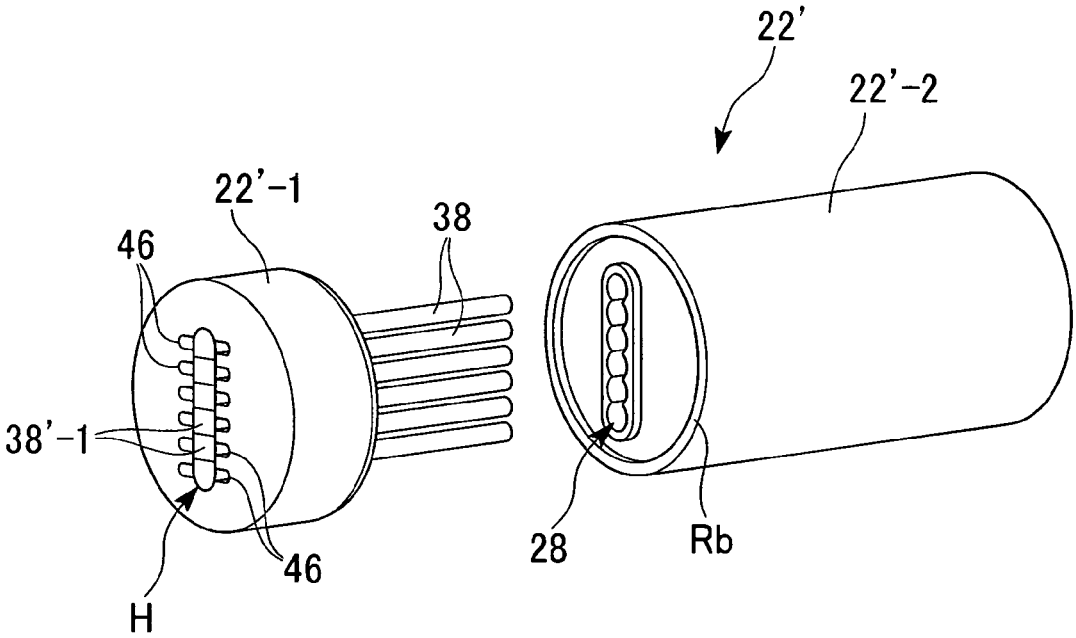
FIG. 15 shows a three-dimensional exploded view of the die set shown in FIG. 14.

Refer to FIGS. 14 and 15, In a die set 18.2, a punch holder is integrated with a multi-channel die 22'. The multi-channel die 22' is composed of a part 22'-1 which supports punches 38', and a part 22'-2 in which the cooling bores 30 are formed.

A hole H is formed in the part 22'-1 in such a way that the proximal ends 38'-1 of the punches 38' are engaged with the hole. The punches. 38' of which the proximal ends 38'-1 are engaged with the hole H are fixed in a line while the distal ends 38'-2 are inserted into the hollow portion 28.

Feed passages 46 are formed in the part 22'-1 so as to communicate with the hole H. Where the proximal ends 38'-1 of the punches 38' are engaged with the hole H, the feed passages 46 can supply the molten copper without plugging by the proximal ends 38'-1.

An air pocket AP is formed between the parts 22'-1 and 22'-2 but not the center and on the circumference of the multi-channel die 22', and the pocket is blocked to communicate with the hollow portion 28 by a center rib Rb around the hollow portion 28. The air pocket AP prevents high temperature from translating from the part 22'-1 to the part 22'-2. Further, the air pocket AP prevents low temperature from translating from the part 22'-2 to the part 22'-1. As a result, the molten copper can flow within the part 22'-1 smoothly, and then the molten copper can be solidified within the part 22'-2 quickly.

1. Method of Measuring Crystal Grain Size

Grain size measurement of various raw tubes was performed in accordance with planimetric procedure regulated in ASTM E112-96. In each of the raw tubes, an average grain size in a plane parallel to the longitudinal direction of the cast tube and an average grain size in a plane perpendicular to the longitudinal direction of the cast tube were determined. Where the aspect ratio was 3:1 or less, in accordance with ASTM E112-96, average grain size was determined based on longitudinal grain size.

2. Grain Size and Product Quality of Tube Surfaces After Drawing

Cast raw tubes of phosphorus-deoxidized copper (C12200, DHP) were subjected to cold drawing with a reduction of area of 90% without intermediately annealing the tubes. Similar raw tubes were subjected to the same cold drawing while performing annealing at an intermediate stage. After the drawing, a surface of each tube was visually inspected so as to examine the occurrence of cracks and/or flaws. The intermediate annealing was performed where the reduction of area was 40%. The results of the visual inspection are shown in Table.

TABLE

Grain size and occurrence of cracks

| | | Results of visual observation of tube surface | |
|---|---|---|---|
| | Grain size | Not-performed intermediate annealing | Performed Intermediate annealing |
| No. 1 | $D_T$ 0.6 mm<br>$D_L$ 1.2 mm | Cracks did not occur | Cracks did not occur |
| No. 2 | $D_T$ 1.0 mm<br>$D_L$ 2.3 mm | Small cracks occurred in rare case. | Cracks did not occur |
| No. 3 | $D_T$ 1.4 mm<br>$D_L$ 3.5 mm | Large numbers of large cracks occurred | Cracks did not occur |

$D_T$ denotes the average grain size in transverse section of columnar structure, and $D_L$ denotes the average grain seize in longitudinal section of the columnar structure.

In cases where the tubes of sample No. 2 were drawn without performing the intermediate annealing, small cracks occurred in rare case. In most of the cases, cracks did not occur and the tubes had acceptable quality as products. Where the tubes of sample No. 3 were drawn without performing the intermediate annealing, large cracks occurred frequently, and the tubes could not have the product quality. Although the occurrence of the cracks can be avoided by performing the annealing *, it requires an additional step and increase of production cost. (* When the tube is subjected to an annealing after drawing to a certain extent, grain size of the structure is refined by recrystallization. Such a refined structure is appropriate for the drawing).

According to the multi-channel copper tube, it is preferable that the average grain size thereof be less than or equal to 2.0 mm, and further preferable that the average grain size thereof be less than or equal to 1.2 mm.

Figure 16:
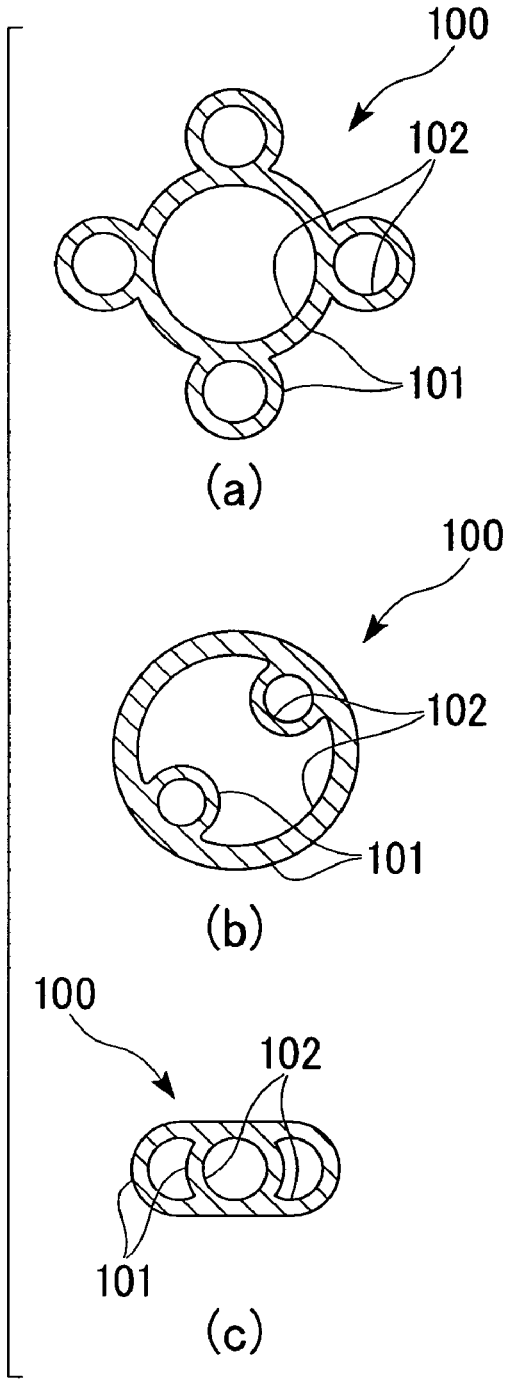
FIG. 16 shows transverse sectional views of different embodiments of multi-channel tubes in accordance with the invention.

Reference is now made to FIG. 16 of the drawings, in which three further embodiments of a multi-channel tube formed in accordance with the invention are illustrated. Naturally, various other arrangements are possible.

Figure 17:
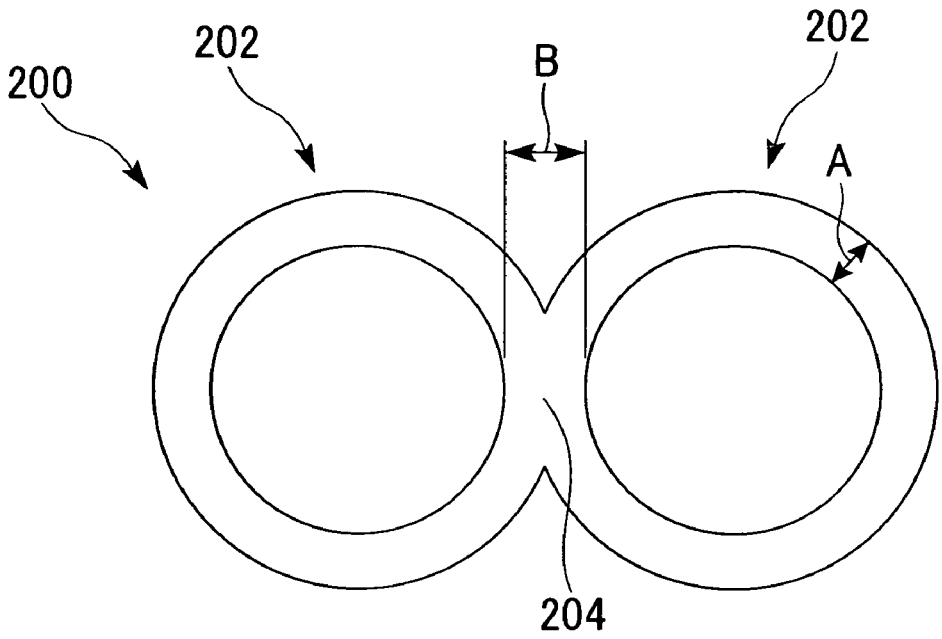
FIG. 17 shows an end view of part of another multi-channel tube in accordance with the invention.

Reference is now made to FIG. 17 of the drawings, in which reference numeral 200 refers generally to another embodiment of multi-channel tube in accordance with the invention. The multi-channel copper tube 200 includes two tubes 202 which are arranged side-by-side and interconnected by a central web 204. The Inventors have found that the relationship between the wall thickness A of the tubes 202 and the width B of the web 204 is important since if the web is too thin the multi-channel copper tube 200 will tend to fail at this point. However, if the web is too thick it results in wasted material. The Inventors believe that the ratio of minimum web thickness B to minimum wall thickness A will be between 1:1 and 4:1, ideally 1.5:1.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

The invention claimed is:

1. A method of manufacturing multi-channel tube having a plurality of channels arranged in parallel by continuous casting, the method comprising:

supplying molten copper to a die set from a crucible, the die set being provided with a hollow portion having an inner surface shaped like a profile of the multi-channel tube, punches which are inserted into the hollow portion from an inlet of the hollow portion to define a space between the inner surface of the hollow portion and each of the punches, and a feed passage for feeding the molten copper from the crucible to the hollow portion, and which is spatially-closed excluding a connection with the crucible and the hollow portion;

solidifying the molten copper as it passes through the space between the inner surface of the hollow portion and each of the punches, and withdrawing the cast multi-channel tube from the die set.

2. A method as claimed in claim 1, in which the molten copper from the crucible is supplied to the hollow portion within the die set by gravity.

3. A method as claimed in claim 1, in which the hollow portion has an inlet end through which molten copper is fed into the hollow portion die and an outlet end, the method further comprising:

inserting an end of a length of starter tube into the outlet end of the hollow portion along the length of the hollow portion, feeding molten copper into the inlet end of the hollow portion, allowing the molten copper to bond with the starter tube and solidify, along with drawing the starter tube out of the hollow portion for a predetermined length or continuously to form a multi-channel tube, and feeding more molten copper into the hollow portion allowing the molten copper to bond with the previously formed multi-channel tube and solidify along with drawing the multi-channel tube out of the hollow portion die on a continuous basis.

4. A method as claimed in claim 3, further comprising cooling at least part of the hollow portion die.

5. A method as claimed in claim 4, in which cooling the die includes feeding coolant into cooling bores which extend into the hollow portion die from its outlet end for part of its length.

6. A method as claimed in claim 4, in which the depth to which the coolant is fed into the hollow portion die and hence the position within the hollow portion die at which the molten copper solidifies is adjustable.

7. A method as claimed in claim 1, further comprising drawing the cast multi-channel tube through one or more dies in order to obtain the desired wall thickness.

8. A method as claimed in claim 7, in which drawing the multi-channel tube involves making use of fixed mandrels.

9. A method as claimed in claim 7, in which the method further comprising using floating mandrels.

10. A method as claimed in claim 9, further comprising inhibiting spinning of the floating mandrels.

11. A method as claimed in claim 10, further comprising making use of non-circular mandrels.

12. A method as claimed in claim 1, further comprising annealing the multi-channel tube.

13. A method as claimed in claim 1, wherein the punches are formed in a manner as tapered or parallel shape, and which protrude from a punch holder.

* * * * *